US005927527A

United States Patent [19]

Montgomery et al.

[11] Patent Number: 5,927,527

[45] Date of Patent: Jul. 27, 1999

[54] SQUEEZE AND TURN CHILD RESISTANT CLOSURE WITH TAMPER INDICATING BAND

[75] Inventors: Gary V. Montgomery; Elizabeth Rudolph, both of Evansville; Mark K. Branson, Newburgh; Jeffrey C. Minnette; C. Ed Luker, both of Evansville, all of Ind.

[73] Assignee: Rexam Plastics, Inc., Evansville, Ind.

[21] Appl. No.: 08/947,343

[22] Filed: Oct. 8, 1997

Related U.S. Application Data

[60] Provisional application No. 60/045,263, May 1, 1997.

[51] Int. Cl.[6] ..... B65D 55/02

[52] U.S. Cl. ..... 215/219; 215/252

[58] Field of Search ..... 215/252, 216, 215/217, 218, 221, 222, 330, 329

[56] References Cited

U.S. PATENT DOCUMENTS

| | | | |
|---|---|---|---|
| 4,109,814 | 8/1978 | Rausing . | |
| 4,180,174 | 12/1979 | Quinn . | |
| 4,261,478 | 4/1981 | Summers . | |
| 4,452,363 | 6/1984 | Davis . | |
| 4,471,878 | 9/1984 | Davis et al. . | |
| 4,548,329 | 10/1985 | Curry . | |
| 4,567,991 | 2/1986 | Anderson . | |
| 4,667,836 | 5/1987 | McLaren | 215/216 |
| 4,752,014 | 6/1988 | House et al. . | |
| 5,147,053 | 9/1992 | Friedenthal . | |
| 5,174,465 | 12/1992 | Luch et al. . | |
| 5,271,512 | 12/1993 | Ekkert . | |
| 5,397,009 | 3/1995 | Salmon et al. | 215/252 |
| 5,551,582 | 9/1996 | Robinson . | |
| 5,570,798 | 11/1996 | Hayashida et al. | 215/252 |
| 5,590,799 | 1/1997 | King . | |
| 5,638,969 | 6/1997 | King | 215/222 X |

FOREIGN PATENT DOCUMENTS

| | | | |
|---|---|---|---|
| 03607717 | 3/1990 | European Pat. Off. . | |
| 2486502 | 1/1982 | France | 215/216 |
| 2031856 | 4/1980 | United Kingdom . | |
| 2108095 | 5/1983 | United Kingdom | 215/216 |

*Primary Examiner*—Stephen K. Cronin
*Assistant Examiner*—Nathan Newhouse
*Attorney, Agent, or Firm*—Middleton & Reutlinger; John F. Salazar

[57] ABSTRACT

The present closure and container combination comprises a child resistant squeeze and turn closure having a tamper indicating band which is removed from the closure after the first removal of the closure from the container. The closure has dual squeeze pads located opposite one another on the outer wall of the closure. Formed at 90 degrees from the squeeze pads are two child resistant lugs which extend inwardly from the closure lower skirt wall. The child resistant lugs extend downwardly below the lowermost edge of the annular skirt of the closure. Frangible webs are positioned at 45 degrees from the external tabs and the squeeze pads and retain the tamper indicating band onto the closure side wall. A first and a second child resistant container lug contacts the closure lugs and are placed on the neck of the container above the tamper indicating bead. The child resistant feature of the closure needs to be overcome before the tamper indicating band is fractured from the closure. After removal of the tamper indicating band, the child resistant lugs extend below the closure side wall to provide a visual cue as to the child protective feature of the closure.

21 Claims, 7 Drawing Sheets

SQUEEZE AND TURN CHILD RESISTANT CLOSURE WITH TAMPER INDICATING BAND

This application claims the benefit of U.S. Provisional Application No. 60/045,263, filed on May 1, 1997.

BACKGROUND OF THE INVENTION 1. Field of the Invention

The present invention relates to child resistant closures and particularly to a squeeze and turn child resistant closure which has a tamper indicating band on the lower edge of the closure annular skirt which is detached from the closure after first removal of the closure from the container.

2. Discussion of the Prior Art

In the prior art, squeeze and turn child resistant closures are well known. These closures typically require pressure to be applied to the closure skirt in order to deform the closure and overcome child resistant lugs formed on the closure and container which coact with each other when the closure is turned in a counter-clockwise direction. Various embodiments of these type squeeze and turn closures are known. Squeeze and turn closures have not historically come with a tamper indicating band nor with a band which breaks only after overcoming the child resistant feature.

U.S. Pat. No. 4,452,363 issued to Davis teaches a tamper resistant and child resistant container and cap assembly whereby a single shelled closure is provided and which utilizes a squeeze and turn child resistant feature. The single shelled closure is conical in shape and requires a ratchet and pawl construction in order to adequately drive the tamper indicating band over the tamper indicating bead. However, the overall conical shape and design of the closure is undesirable in that increased distance from the lower portion of the closure to the container neck may cause the closure to wobble on the threads of the container making it much more difficult to thread the closure on the container and increase the possibility of mis-aligning the threads. Further, such increased distance must be overcome by increased squeeze pressure to deform the closure over the child resistant lugs on the container.

U.S. Pat. No. 4,471,878 to Davis, et al. teaches a child and tamper resistant closure wherein the closure is a double shelled closure and the outer shell of the closure must be deformed in order to unthread the closure from the container. However, the double shell design increases the materials required for manufacturing the closure, increases the mold complexity, and provides a somewhat flimsy feeling closure due to the space between the inner and outer shell of the closure.

None of the prior art closures provide a squeeze and turn threaded single shell closure which has a tamper indicating feature and which is significantly easy to produce, which provides visual cues as to the child resistant feature, which incorporates a tamper indicating feature on the closure and which has a substantially standard screw cap closure appearance.

SUMMARY OF THE INVENTION

It is therefore an object of the present invention to provide a child resistant closure which has a tamper indicating band, said band being broken after the child resistant feature is unlocked. It is a further object of the present invention to provide a squeeze and turn child resistant closure which is combined with a tamper indicating band and which is constructed such that the closure rises off of the container at an accelerated angle when unthreading such that the child resistant lugs on the closure meet the lugs on the container only once when turning the closure in the counter-clockwise direction.

It is also an object of the present invention to provide a single shelled threaded closure which has a child resistant feature, a tamper indicating feature and a compressed profile of the threads on the upper portion of the closure. A further object of the present invention is to provide a closure which has a tamper indicating band, child resistant capabilities and which has a substantially vertical side wall profile. An even further object of the present invention is to provide a child resistant and tamper indicating closure wherein child resistant tabs extending downward from the closure provide a visual cue to the user of the child resistant locking mechanism and the deformation requirement for overcoming said locking feature on the container.

In light of these objectives, the present invention is for a squeeze and turn child resistant closure having a tamper indicating band on the lower edge thereof. There are two opposing inwardly directed child resistant lugs or tabs which are formed on the lower edge of the closure and which extend upwards and downwards therefrom. The tamper indicating band wraps around the lower portion of these inwardly directed tabs or lugs. The child resistant tabs or lugs are angled in the backwards direction so that they slide over similarly angled mating lugs on the container when the closure is threaded onto the container. However, upon removal of the closure and after counter-clockwise rotation thereof, these back angled lugs coact with the mating container lugs preventing continued counter-clockwise rotation. Additionally, on the lower edge of the closure side wall, there are frangible intermittent webs which retain the tamper indicating band onto the bottom edge of the side wall of the closure. The double helical threads on the closure and container are such that the closure rises rapidly on the container neck when unthreading occurs such that the user must first overcome the child resistant feature before the tamper indicating band is detached from the lower edge of the closure side wall. These threads are also compressed within the upper portion of the closure thereby providing a significant lower portion of the closure side wall available for adequate deformation and oralizing to overcome similar lugs on the neck of the container.

Finally, the present invention is for a tamper-resistant and child resistant closure and container, comprising: a container having an upwardly extending neck, said container neck having at least one thread thereon, an outwardly extending tamper indicating bead below said at least one thread and at least one child resistant lug above said tamper indicating bead; a closure having a top wall and a depending side wall, said side wall being substantially vertical; at least one child resistant lug extending inwardly from the interior of said closure side wall; and, a tamper indicating band frangibly connected to said depending closure side wall.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
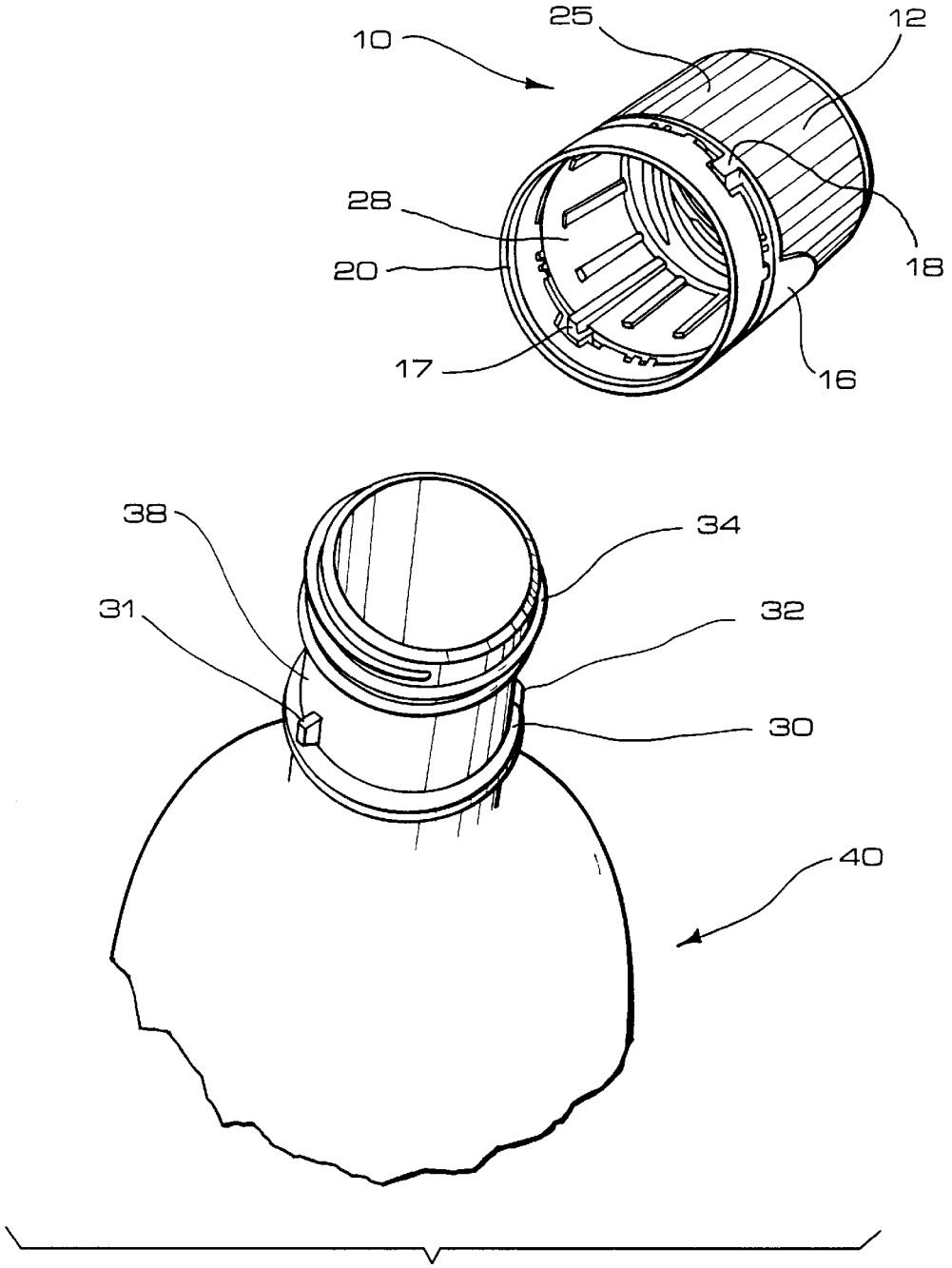
FIG. 1 is a perspective view of the closure and container combination of the present invention.

The squeeze and turn child resistant closure 10 having a tamper indicating band 20 is shown in FIG. 1. Also shown is the matching container 40 wherein mating child resistant lugs 31 and 32 are utilized to provide the child resistant feature in combination with inwardly directed lugs 17 and 18 of closure 10. Closure 10 is a squeeze and turn child resistant closure which depends upon deformation of the annular skirt 12 in order to overcome the child resistant lugs 31 and 32 on the container 40. Opposing squeeze pads 15 and 16 are formed on the lower portion of annular skirt 12 to provide proper location of opposing pressure required to ovalize the closure and overcome the child resistant lugs 31 and 32 on the container. Mating lugs 17 and 18 which are formed at 90° from each squeeze pad 15 and 16 are directed inwards from the interior sidewall 12 of closure 10 and are thereby deformed outward and ride over lugs 31 and 32 on the container. A tamper indicating band 20 is also provided on the closure 10 in order to provide a visual cue that the closure 10 has been previously removed from the container 40.

As noted in the drawings, closure 10 is a substantially vertical side wall one piece integrally molded closure wherein annular skirt or side wall 12 depend directly below top wall 11. Additionally, opposing threads 14 and 14*a* of closure 10 are located at the upper most portion of side wall 12 in order to increase the surface area of skirt 12 below said threads thereby increasing the deformation efficiency of skirt 12. This compressed profile of threads 14 and 14*a,* the vertical distance 26 shown in FIG. 5, allows less pressure to be applied to skirt 12 at pads 15 and 16 in order to overcome the child resistant feature. The lugs 17 and 18 on the closure depend below the lower most edge of annular skirt 12 so that, after removal of the tamper indicating band 20, lugs 17 and 18 which contact mating lugs 31 and 32 on the container are easily visible and provide adequate visual cues as to the child resistant feature of the closure and container combination. The exterior of annular skirt 12 of the closure 10 has knurling 25 which increase the handling ability of depending skirt or side wall 12 for threading and unthreading of the closure 10 on container 40.

Figure 2:
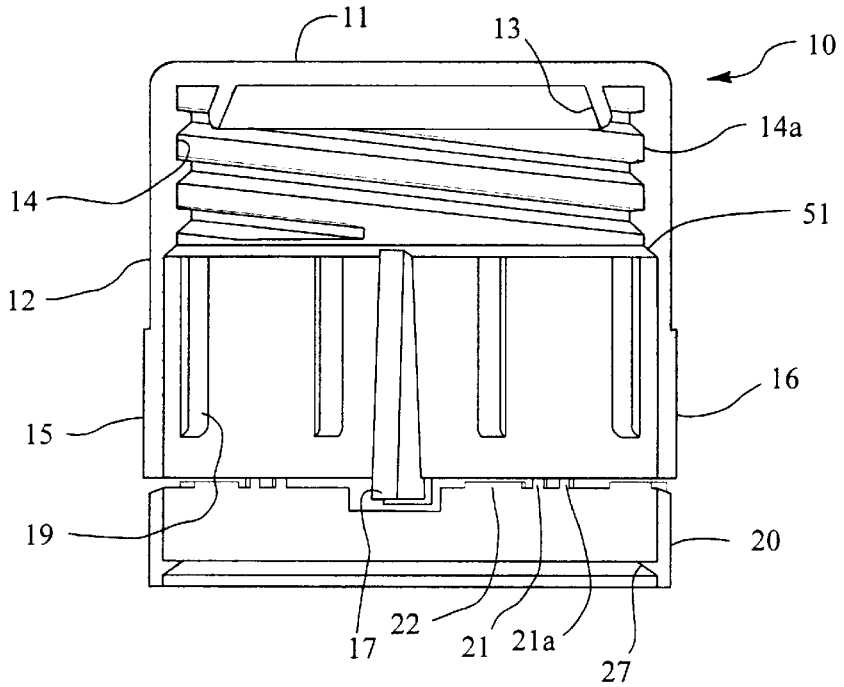
FIG. 2 is a sectional side view of the squeeze and turn child resistant closure of FIG. 1.

Turning to FIG. 2, the closure 10 is shown wherein the threads 14 and 14*a* are shown with a compressed profile 26 towards the top portion of closure 10. Threads 14 and 14*a* are double helical in order to decrease the rotation distance before threads 14 and 14*a* catch dual mating threads 34 and 34*a* on the container 40. Also shown in FIG. 2, depending below top wall 11, is annular seal 13 which fits into the interior neck portion 33 of container neck 38 providing a linerless seal structure. Seal 13 as is shown in FIG. 2, is slightly angled outwardly in order to provide an adequate compression seal against the interior wall 33 of container neck 38. In fact, upon full threading of the closure 10 onto container 40, annular seal 13 has an increased angle downward as compared to top wall 11 by annular plug seal 13 compressing against vertical wall 38. Also shown in FIG. 2 are compression pads 15 and 16 which are formed on opposite sides of the lower portion of closure 10 on the annular skirt 12 and which are 90° from the inwardly directed back angled lugs 17 and 18.

Figure 2A:
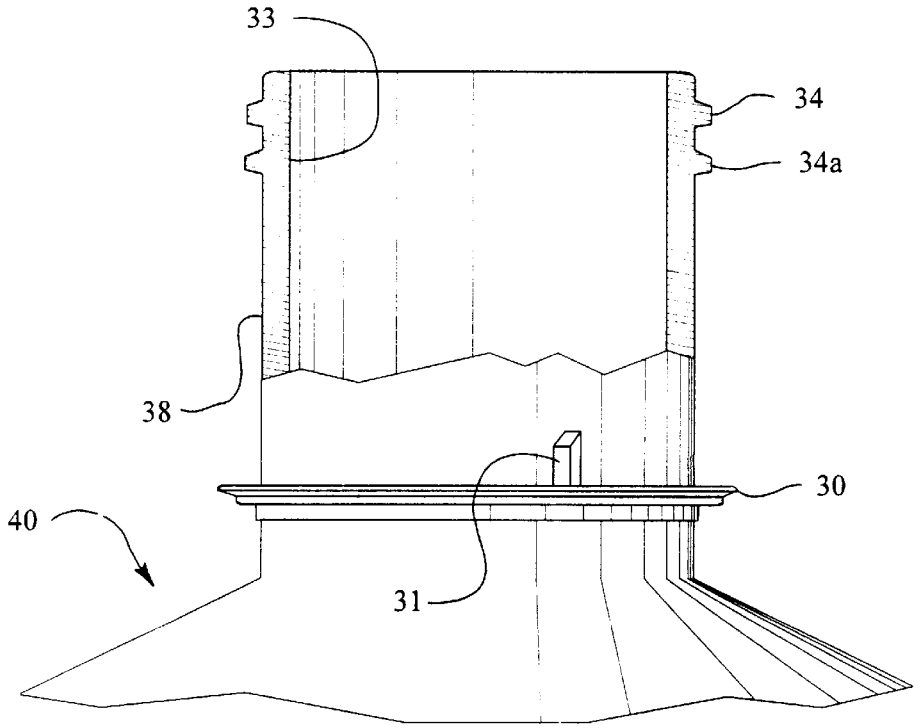
FIG. 2*a* is a partial sectional side view of the container shown in FIG. 1.

FIG. 2*a* details the container wherein upwardly extending vertical neck portion 38 of the container 40 is somewhat lengthened between threads 34 and 34*a* bead 30 in order to provide adequate distance between the threads 34 and 34*a* and the child resistant lugs 31 and 32 extending outwardly from the container for deformation of closure 10. Thus closure 10 must deform below threads 14 and 14*a* in order to overcome mating lugs 31 and 32 on container 40 and the extension of neck portion 38 between threads 34 and 34*a* and bead 30 allows such distortion readily.

Additionally shown is tamper indicating bead 30 which is an outwardly extending annular bead designed to prevent tamper indicating band 20 on the closure 10 from being removed with the closure 10 once the consumer unthreads the closure 10 from the container 40. Lugs 31 and 32, extending upwards from bead 30, are trapezoidal in shape and angled slightly in the clockwise direction in order to increase the ability for lugs 17 and 18 directed inwardly on the closure to pass there over when the closure is threaded onto the container. This angle also increases the locking ability of back angled lugs 31 and 32 when counterclockwise rotation of the closure causes lugs 17 and 18 to coact therewith. The lugs 17 and 18 on closure 10 extend upward to beveled point 51 formed on the interior of closure side wall 12. Lugs 17 and 18 taper slightly inward on wall 12 as the lugs get closer to beveled end point 51 of side wall 12.

Lugs 17 and 18 are back angled lugs approximately 30° in order to increase the efficiency of the child resistant feature. As previously indicated, the back angled nature of lugs 17 and 18 allow the lugs to glide over mating lugs 31 and 32 formed on container neck 38 when threading closure 10 clockwise onto container 40. However, due to the angle of the lugs 17 and 18 and mating lugs 31 and 32 on the container, when unthreading the closure 10 in the counterclockwise direction, closure lugs 17 and 18 do not easily pass over mating lugs 31 and 32 thereby requiring the closure to be deformed into an oval shape in order for lugs 17 and 18 to overpass mating container lugs 31 and 32. Additionally, shown in FIG. 2, is tamper indicating band 20 and the frangible connection pairs 21 and 21*a* pairs which connects tamper indicating band 20 to the bottom edge of annular skirt 12 of closure 10. Frangible connection pairs 21 and 21*a* are designed so as to slightly deform and compress when the closure is threaded onto the container in order for the tamper indicating band to pass over tamper indicating bead 30 on container 40.

Figure 3:
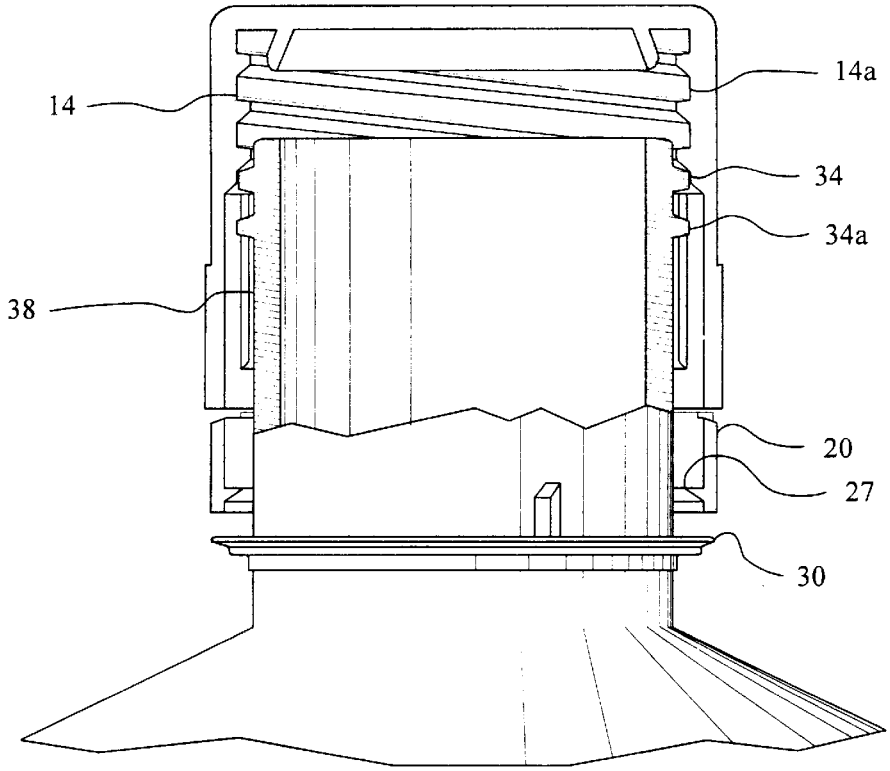
FIG. 3 is a partial sectional side view of the closure and container combination of FIG. 1.
Figure 4:
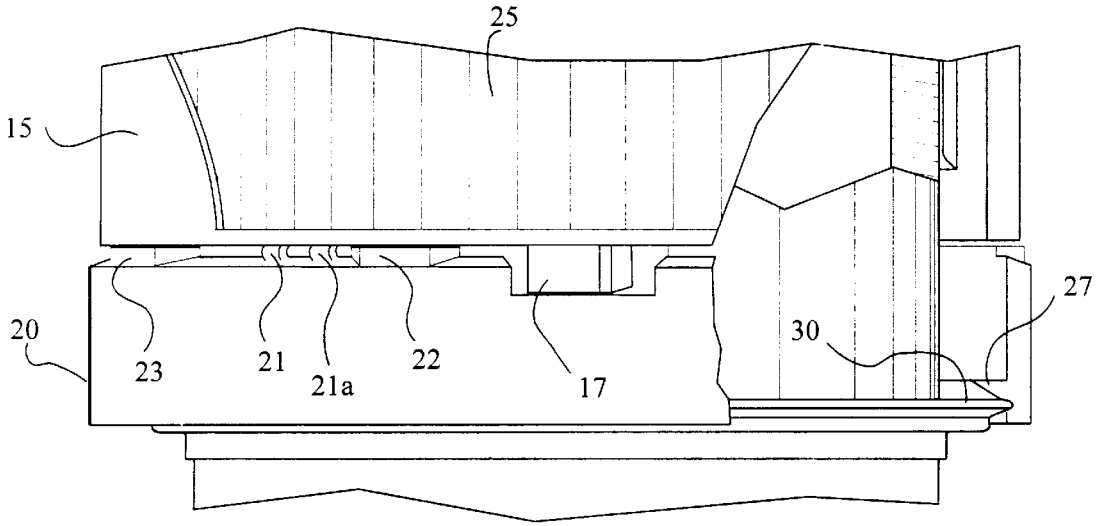
FIG. 4 is a closeup sectional view of the tamper indicating band and closure shown in FIG. 3.

As shown in FIG. 3, dual thread start 14 and 14*a* on the closure mates with double thread 34 and 34*a* formations on the container in order to easily thread the closure on the container without mis-aligning the threads. Threads 34 and 34*a* have starts on the top of neck 38 which are 180° apart. The threads 34 and 34*a* are angled such that the threads pull down the closure 10 prior to the tamper indicating band 20 contacting bead 30. Also shown in FIG. 3 is inwardly directed tamper indicating bead 27 on tamper indicating band 20 which must pass over outwardly directed bead 30 on container neck 38. When threading the closure onto the container, bead 27 compresses downward against outwardly directed bead 30 causing frangible connections 21 and 21*a* to slightly deform and compress as is shown in FIG. 4. This is due to the resistance from the diameter bead 27 against outwardly extending slightly smaller diameter bead 30 on the container. Sufficient downward pressure must be exerted by threading the closure into the container causing the bead 27 to ride over outwardly extending bead 30. At such time until such pressure is exerted, compression of the frangible connections 21 and 21*a* occurs as is shown in FIG. 4. Push pads 22 and 23 formed on the upper portion of tamper indicating band 20 contact the lower edge of the annular skirt 12 of closure 10 in order to further exert force by the closure against the tamper indicating band pushing said band 20 over tamper indicating bead 30. Such pressure is sufficient to allow tamper indicating band 20 to pass over container bead 30 without sufficient force which would cause frangible connections 21 and 21*a* to be fractured. Push pads 22 and 23 are formed such that there is sufficient contact points for the lower edge of the closure side wall 12 to adequately force the tamper indicating band 20 over bead 30. In the preferred embodiment shown in the drawings, six push pads are formed on the top edge of the tamper indicating band 20. Frangible connections 21 and 21*a* are formed in pairs around the lower rim of closure 10 providing a total of 8 frangible connections retaining tamper indicating bead 20 to closure 10. These connectors are formed at 45° angles on either side of inwardly directed lugs 17 and 18.

Figure 5:
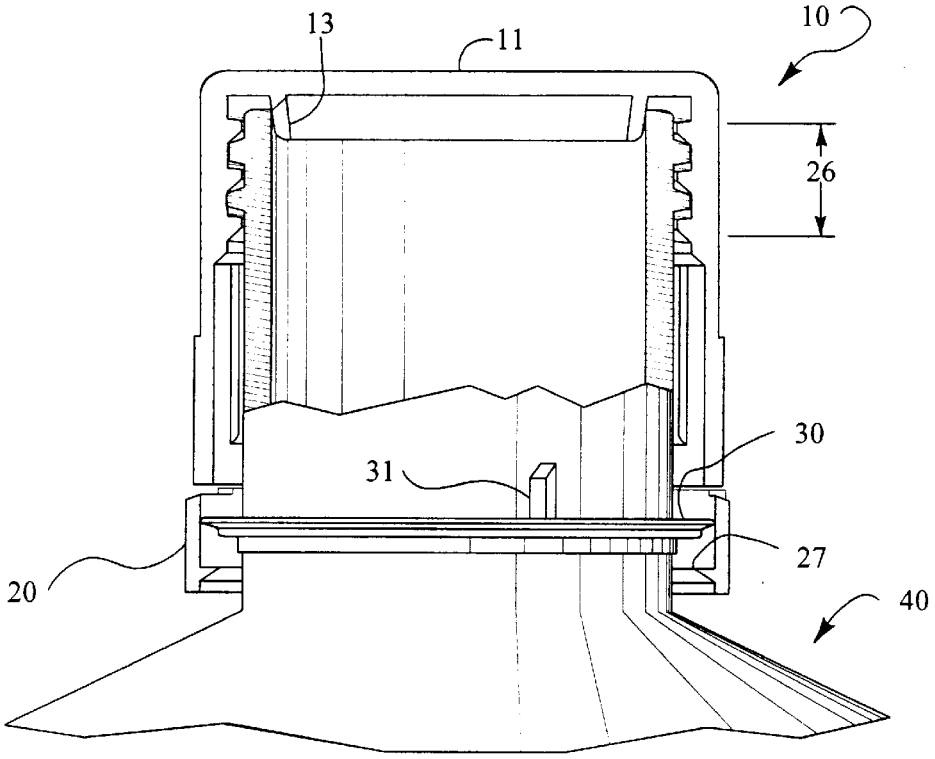
FIG. 5 is a sectional side view of the closure and container combination shown in FIG. 1.
Figure 6:
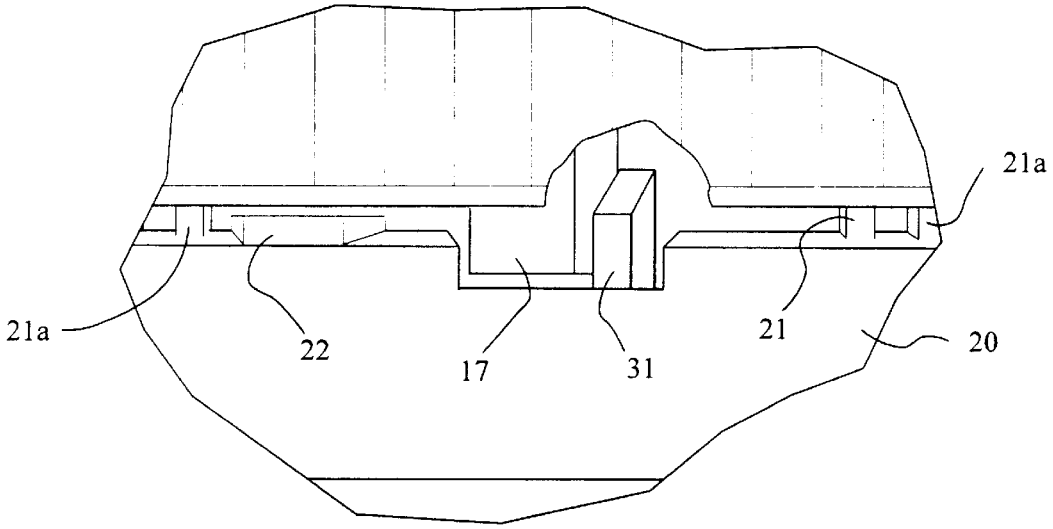
FIG. 6 is a closeup side view of the closure and container of FIG. 5.
Figure 10:
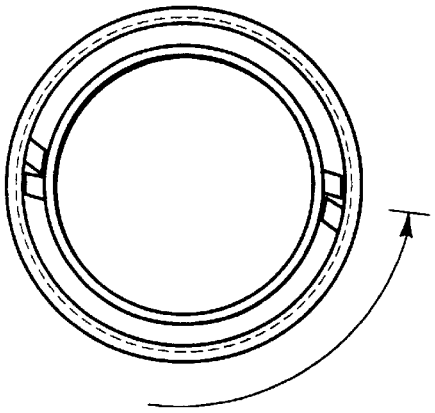
FIG. 10 is a top sectional view of the closure and container combination wherein the closure is unthreaded from the container.
Figure 10A:
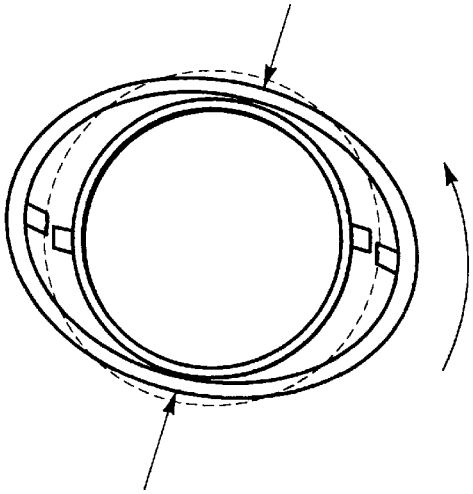
FIG. 10*a* is a top sectional view of the closure and container combination of FIG. 1 wherein the closure is deformed to overcome the child resistant feature; and, FIG. 11 is a perspective view of the closure and container combination detailing the child resistant feature of the combination.

As is shown in FIG. 5, inwardly directed bead 27 on tamper indicating band 20 has bypassed outwardly directed tamper indicating bead 30 and is in such a position that unthreading of closure 10 from the container 40 causes tamper indicating bead 20 to remain on the container 40 due to fracturing of webs 21 and 21*a*. However, sufficient vertical distance exists between inwardly directed bead 27 on tamper indicating band 20 and outwardly directed bead 30 on the container such that frangible connectors 21 and 21*a* are not broken until child resistant lugs 17 and 18 bypass mating lugs 31 and 32 on the container. As is shown in FIG. 6, lug 17 is immediately adjacent to lug 31 on the container thereby preventing continued counter-clockwise rotation of the closure 10. In order to overcome said child resistant feature, pressure must be exerted on thumb pads 15 and 16 to ovalize the closure as is shown in FIG. 10*a* in order for lugs 17 and 18 to bypass lugs 31 and 32. As is shown in FIG. 10, counter-clockwise rotation is allowed until mating lugs 17 and 18 contact container lugs 31 and 32. Once sufficient pressure is applied to pads 15 and 16 in order for lugs 18 and 17 to override lugs 31 and 32, tamper indicating bead 30 is immediately adjacent to inwardly directed bead 27 on band 20. Continued counter-clockwise rotation causes the plurality of frangible connection pairs 21 and 21*a* to fracture thereby separating tamper indicating band 20 from the closure 10.

Figure 7:
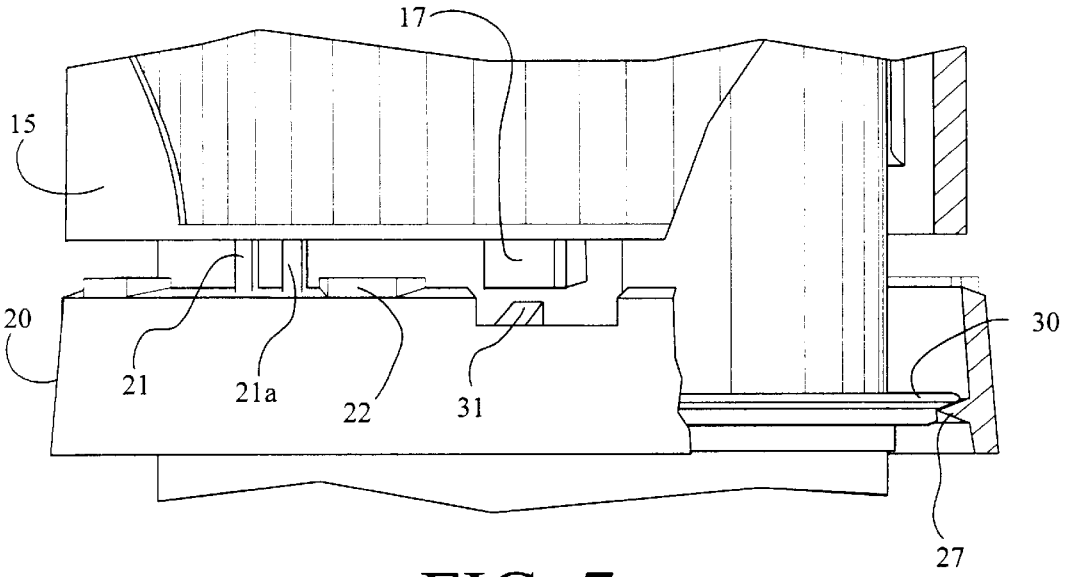
FIG. 7 is a closeup view of the closure and container of FIG. 1.
Figure 8:
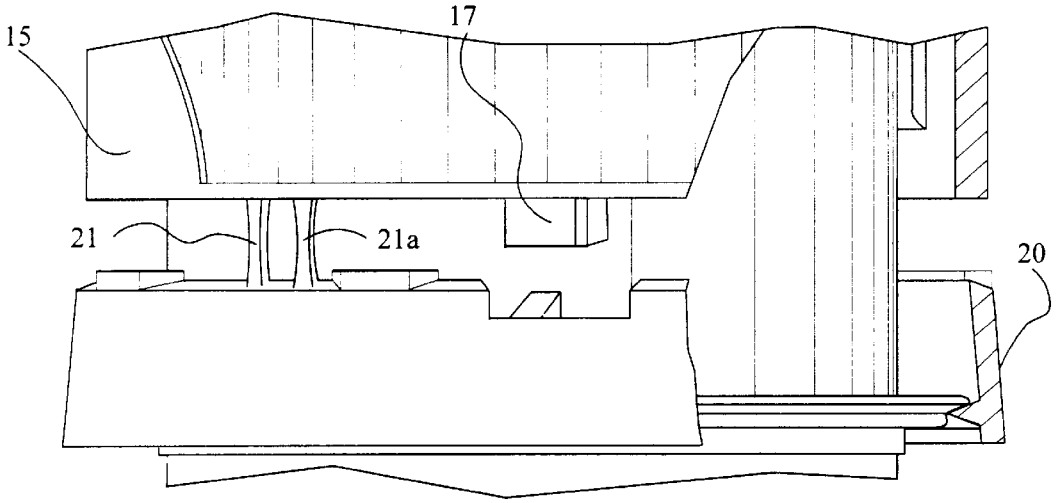
FIG. 8 is a closeup side view of the closure and container of FIG. 1 wherein the tamper indicating band has been fractured from the closure.
Figure 9:
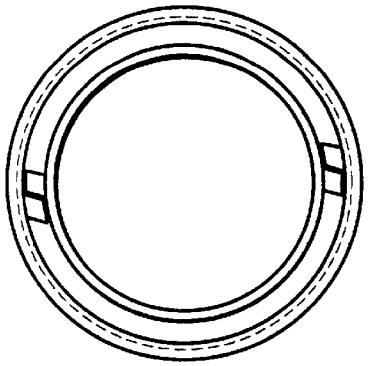
FIG. 9 is a top view of the child resistant feature of the closure and container of FIG. 1.
Figure 9A:
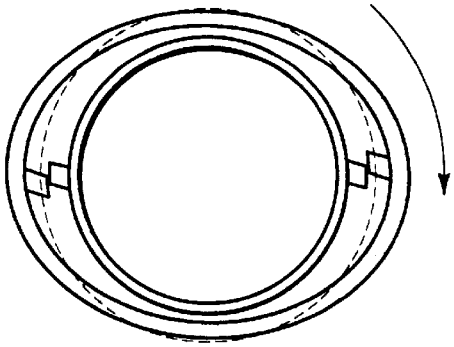
FIG. 9*a* is a top sectional view of the closure and container of FIG. 1 wherein the closure is threaded onto the container.

As is shown in FIG. 7 and FIG. 8, inwardly directed lug 17 bypasses outwardly directed lug 31 on the container. Inwardly directed tamper indicating bead 27 on the tamper indicating band 20 is below container bead 30 on the container. Continued counter-clockwise rotation causing lug 17 to further bypass mating lug 31 on the container causes distortion of frangible connectors 21 and 21*a* on the closure as is shown in FIG. 8. Continued counter-clockwise rotation of the closure without the need to apply squeeze pressure fractures pairs 21 and 21*a* and separates the band 20 from the closure 10.

Figure 11:
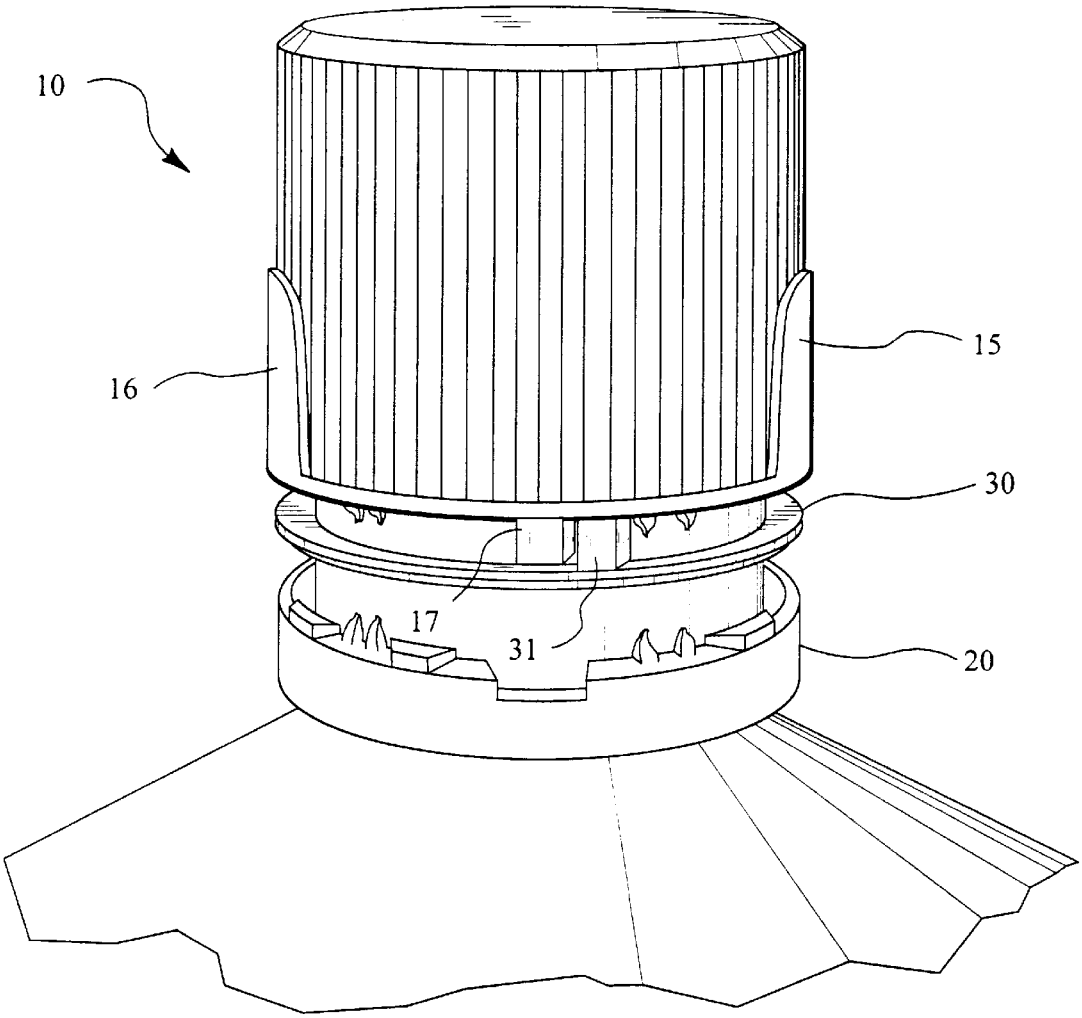

Turning to FIG. 11, the detached tamper indicating band 20 hangs below the outwardly extending bead 30 due to the removal of closure 10 from container 40. As has been described, bead 30 causes fracturing of the plurality of pairs of webs 21 and 21*a*. After detachment of the tamper indicating band 20 from closure 10, the child resistant feature of the closure and container is clearly visible. In attempting to remove the closure from the container, lugs 17 and 18 contact lugs 31 and 32 on the neck of the container. It is thus clearly visible to the consumer that the child resistant feature must be overcome before the closure may be removed. An additional aspect of the depending child resistant lugs 17 and 18 from closure skirt 12 is that upon first reapplication of the closure to the container, after the tamper indicating band has been separated, the lugs act to drive the tamper indicating band back downward over the bead 30. When the closure is removed before detachment of the tamper indicating band 20, the band may be even with the bead 30 on the container neck 38 when frangible connection pairs 21 and 21*a* finally fracture. The bead 30, however, will prevent the entire band 20 from rising upwards past bead 30. At the point where the webs 21 and 21*a* actually fracture on the band 20, inwardly directed bead 27 may prevent the band from falling downward down neck 38. Upon reapplication of the closure 10 to the container 40, lugs 17 and 18 will force the severed band 20 downward completely past the outwardly directed bead 30.

The foregoing detailed description is given primarily for clearness of understanding and no unnecessary limitations are to be understood therefrom for modifications will become obvious to those skilled in the art upon reading this disclosure and may be made without departing from the spirit of the invention of the scope of the appended claims.

What we claim is:

1. A tamper-resistant and child resistant closure and container, comprising:

a container having an upwardly extending neck, said container neck having at least one thread thereon, an outwardly extending tamper indicating bead below said at least one thread and at least one child resistant lug above said tamper indicating bead;

a closure having a top wall and a depending cylindrical single side wall, said side wall being substantially vertical with at least one mating thread in mating relation with said at least one thread on said container neck;

at least one child resistant lug extending inwardly from the interior of said closure side wall, said child resistant lug on said closure extending below a bottom edge of said depending side wall; and, a tamper indicating band frangibly connected to said depending closure side wall.

2. The closure and container of claim 1 wherein said container has an extended neck portion between said tamper indicating bead and said at least one thread.

3. The closure and container of claim 1 wherein said at least one thread includes first and second threads formed 180 degrees apart on said container neck and said at least one mating thread includes a first mating thread and a second mating thread in mating relation with said first and said second threads.

4. The closure and container of claim 1 wherein said at least one child resistant lug is a first and a second child resistant lug formed on opposite sides of said closure sidewall.

5. The closure and container of claim 1 wherein said closure further comprises an annular seal depending below said top wall.

6. The closure and container of claim 1 wherein said closure further comprises a first and a second compression pad formed on diametrically opposite side of the exterior of said depending side wall.

7. The closure and container of claim 1 wherein after said closure is fully applied to said container, said child resistant lugs must be overcome before said tamper indicating band is fractured from said closure.

8. The closure and container of claim 1 wherein said child resistant lug on said closure contacts said child resistant lug on said container only once during said unthreading of said closure from said container.

9. The closure and container of claim 1 further comprising an inwardly directed bead on said tamper indicating band and wherein said child resistant lug on said closure passes over said child resistant lug on said container before said bead on said tamper indicating band contacts said outwardly extending bead on said container.

10. The closure and container of claim 1 wherein said tamper indicating band is further comprises of a plurality of push pads on the top edge of said band.

11. The closure and container of claim 10 wherein said plurality of push pads is six push pads formed on the top edge of said tamper indicating band.

12. The closure and container of claim 1 wherein said tamper indicating band is further comprises of a plurality of frangible webs connecting said band to said closure, said webs fractured upon first removal of said closure from said container.

13. The closure and container of claim 12 wherein said plurality of frangible webs is further comprised of a plurality of pairs of frangible webs.

14. The closure and container of claim 13 wherein said plurality of pairs of frangible webs is four pairs of frangible webs, said pairs formed 90 degrees apart from each other.

15. The closure and container of claim 1 wherein said at least one child resistant lug on said closure is further comprised of diametric opposing inwardly directed child resistant lugs extending inward on the lower portion of said closure side wall.

16. The closure and container of claim 15 wherein said lugs are back angled lugs.

17. The closure and container of claim 16 wherein said lugs on said closure are back angled in the clockwise direction about 30 degrees.

18. The closure and container of claim 16 wherein said child resistant lugs on said closure depend below the bottom edge of said depending side wall.

19. The closure and container of claim 18 wherein said tamper indicating band has a recessed notch into which said child resistant lugs fit into.

20. A tamper-resistant and child resistant closure and container, comprising:

a container having an upwardly extending neck, said container neck having at least one thread thereon, an outwardly extending tamper indicating bead below said at least one thread and a first and a second child resistant lug;

a closure having a top wall and a depending side wall;

a first and a second child resistant lug extending inwardly from the interior of said closure side wall; and, a tamper indicating band frangibly connected to said depending closure side wall by a plurality of frangible connectors between said tamper indicating band and said side wall;

wherein said first and said second tamper indicating lug on said closure extend below the bottom edge of said closure side wall.

21. A tamper-resistant and child resistance closure and container, comprising:

a container having an upwardly extending neck, said container neck having a first and a second opposing thread thereon, an outwardly extending tamper indicating bead below said first and second thread and a first and a second child resistant lug directed upwards from said tamper indicating bead;

a closure having a top wall and a depending cylindrical single side wall;

a first and a second child resistant lug extending inwardly from the interior of said closure side wall, said lugs on said closure being back angled lugs, said lugs on said closure extending below a bottom edge of said closure side wall; and, a tamper indicating band frangibly connected to said depending closure side wall by a plurality of frangible connectors between said tamper indicating band and said side wall; and, wherein said tamper indicating band detaches from said closure only after said first and second child resistant lugs on said closure pass over said first and second child resistant lugs on said container.

* * * * *